US007578018B2

(12) United States Patent
Choi

(10) Patent No.: US 7,578,018 B2
(45) Date of Patent: Aug. 25, 2009

(54) WASHING MACHINE AND METHOD FOR SUPPLYING WATER THEREOF

(75) Inventor: Hyo Sik Choi, Busan-si (KR)

(73) Assignee: LG Electronics Inc., Seoul (KR)

( * ) Notice: Subject to any disclaimer, the term of this patent is extended or adjusted under 35 U.S.C. 154(b) by 685 days.

(21) Appl. No.: 11/175,327

(22) Filed: Jul. 7, 2005

(65) Prior Publication Data

US 2006/0080787 A1 Apr. 20, 2006

(30) Foreign Application Priority Data

Jul. 8, 2004 (KR) ..... 10-2004-0053116

(51) Int. Cl.
*D06F 39/08* (2006.01)

(52) U.S. Cl. ..... 8/158; 68/12.19

(58) Field of Classification Search ..... 8/158, 8/159; 68/17 R, 207; 134/184, 198
See application file for complete search history.

(56) References Cited

U.S. PATENT DOCUMENTS 3,513,866 A * 5/1970 Alger et al. ..... 68/17 R
3,747,645 A * 7/1973 Holster et al. ..... 137/838
4,875,607 A 10/1989 Torita et al.
5,469,719 A 11/1995 Imai et al.
6,826,933 B2 * 12/2004 Merkle et al. ..... 68/17 R

FOREIGN PATENT DOCUMENTS

| | | | |
|---|---|---|---|
| DE | 34 03 628 | * | 8/1985 |
| DE | 34 03 852 | * | 8/1985 |
| DE | 38 03 196 | * | 8/1989 |
| DE | 43 18 287 | * | 12/1994 |
| DE | 197 28 649 | * | 1/1999 |

* cited by examiner

*Primary Examiner*—Frankie L Stinson
(74) *Attorney, Agent, or Firm*—Birch, Stewart, Kolasch & Birch, LLP

(57) ABSTRACT

A washing machine and a method for supplying water thereof are disclosed. The washing machine comprises a supply valve for supplying cold/warm water into a tub, a water level detection unit for detecting a water level in the tub, and a microcomputer for performing an intermittent water supply and a continuous water supply by controlling an amount of water supplied to the tub from the water supply valve via a detergent barrel, and for controlling water supply according to the water level in the tub detected by the water level detection unit. The intermittent and continuous water supply is performed in such a manner of supplying water and stopping the water supply, and water supply time is differently set for the primary and secondary intermittent water supply, so that the detergent can be smoothly supplied to the tub without remaining in the barrel.

8 Claims, 5 Drawing Sheets

WASHING MACHINE AND METHOD FOR SUPPLYING WATER THEREOF

BACKGROUND OF THE INVENTION

1. Field of the Invention

The present invention relates to a washing machine and a method for supplying water thereof. More particularly, the present invention relates to a washing machine and a method for supplying water thereof, which performs a primary intermittent water supply to allow detergent to be smoothly supplied into the washing machine at an initial water supply, and a secondary intermittent water supply by changing a water supplying interval or a water supplying time to remove a remaining detergent.

2. Description of the Related Art

Generally, a washing machine is used to remove contaminants stuck to laundry, and is operated by course of supplying water such that the laundry is immersed in water, dissolving a suitable amount of detergent to the water so as to allow the contaminants stuck to the laundry to be removed by chemical reaction with the detergent, and rotating a tub having the laundry contained therein so as to force the contaminants of the laundry to be removed by mechanical friction or vibration between the water and the laundry.

Referring to FIG. 1, a conventional washing machine 1 comprises a tub (not shown) for containing laundry, a motor (not shown) for rotating the tub, and a microcomputer for controlling general conditions and a washing process of the washing machine 1.

The washing machine 1 further comprises on/off type water supplying/draining valves (not shown), and performs the washing process for the laundry contained in the tub according to control of the microcomputer.

The microcomputer controls the motor according to a washing process preset by a user to rotate the tub in order to remove contaminants from the laundry.

In order to remove contaminants from the laundry by controlling the water supplying/draining valves, the microcomputer performs a series of washing steps by controlling an amount of water supplied to the tub or a water supply time into the tub.

At this time, in order to allow detergent to be supplied to the tub, water supplied from the water supply valve must be supplied to the tub after passing through a detergent barrel.

The microcomputer controls the water supply valve such that the washing machine performs an intermittent water supply so as to allow the detergent to be smoothly supplied from the detergent barrel to the tub, and then performs a successive water supply so as to allow water to be supplied to a predetermined level in the tub.

However, the washing machine 1 has a problem in that, even if the intermittent water supply is performed at an initial water supply, the detergent is coagulated within the detergent barrel or formed thereon with a temporary film, causing the detergent to remain in the detergent barrel after supplying water.

Additionally, when the detergent remains in the detergent barrel, it cannot be removed after being coagulated in the detergent barrel, and at this time, the remaining detergent in the detergent barrel can be supplied to the tub during a rinsing process after the washing process, thereby causing the detergent to remain in the laundry after completion of laundry washing.

SUMMARY OF THE INVENTION

The present invention has been made to solve the above problems, and it is an object of the present invention to provide a washing machine and a method for supplying water thereof, which performs multistage water supply in such a manner of repeating an intermittent water supply and a continuous water supply by controlling a water supply time or interval when supplying detergent at an initial water supply stage, thereby removing the detergent remaining in a detergent barrel.

In accordance with one aspect of the present invention, the above and other objects can be accomplished by the provision of a washing machine, comprising: a water supply valve for supplying cold/warm water into a tub; a water level detection unit for detecting a water level in the tub; and a microcomputer for performing an intermittent water supply and a continuous water supply by controlling an amount of water supplied to the tub from the water supply valve via a detergent barrel, and for controlling water supply according to the water level in the tub detected by the water level detection unit.

The microcomputer may comprise a water supply controller for performing the intermittent water supply and the continuous water supply by controlling the amount of water supplied to the tub according to the water level in the tub sent from the water level detection unit while controlling a water supply time or interval so as to force detergent remaining in the detergent barrel to be also supplied to the tub; and a timer for checking a period for which the water is supplied to the tub.

In accordance with another aspect of the present invention, a washing method of the washing machine is provided, comprising: the first step of performing a primary intermittent water supply at an initial water supply stage for allowing detergent in a detergent barrel to be supplied into the tub; the second step of performing a primary continuous water supply for supplying water to a first reference water level in the tub; the third step of performing a secondary intermittent water supply for removing the detergent remaining in the detergent barrel; and the fourth step of performing a secondary continuous water supply for continuously supplying water to a second reference water level in the tub.

At the first step, the primary intermittent water supply may be repeated in such a manner of supplying the water for a short period and then stopping the water supply for a predetermined period such that the detergent is supplied to the tub together with the water supplied to the tub.

The primary intermittent water supply may be performed in such a manner of supplying the water for 0.3 seconds, and then stopping the water supply for 2 seconds.

At the first step, the primary intermittent water supply may be repeated three times.

At the third step, the secondary intermittent water supply may be repeated in such a manner of supplying the water for 5 seconds and then stopping the water supply for 12 seconds to remove the detergent remaining in the detergent barrel.

At the third step, the secondary intermittent water supply may be repeated three times.

The washing machine and the method for supplying water thereof perform the multistage water supply by repeating the intermittent water supply and the continuous water supply in such a manner of supplying water and stopping the water supply, and control the water supply time or interval by differently setting a water supply time for the primary intermittent water supply and the secondary intermittent water supply, thereby allowing the detergent to be smoothly supplied to the tub while preventing the detergent from remaining in the detergent barrel.

Thus, the washing machine and the method for supplying water thereof enable smooth supply of detergent, thereby preventing consumption of detergent while enhancing user convenience by allowing the detergent remaining in the detergent barrel to be completely removed during the washing process by the water supplied to the tub.

Additionally, the washing machine and the method for supplying water thereof remove the detergent remaining in the detergent barrel as described above, and thus reduce contamination of the laundry caused by the detergent, thereby enhancing sanitation of the laundry.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Preferred embodiments of the present invention will be described in detail with reference to the accompanying drawings.

It should be noted that although various embodiments can be realized within the scope of the invention, most preferred embodiments of the invention will be described hereinafter.

Figure 1:
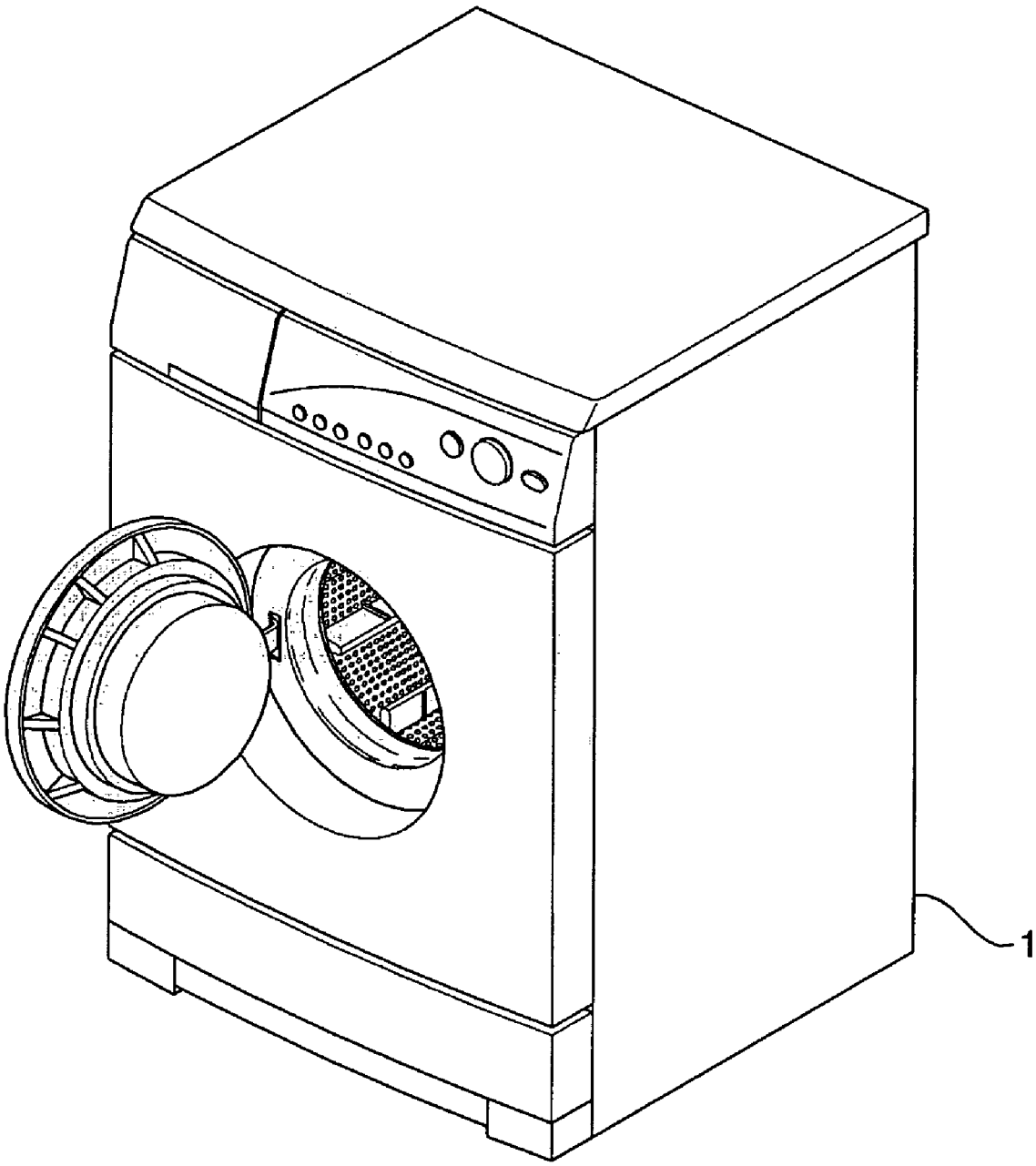
FIG. 1 (Prior Art)
FIG. 1 is a diagram illustrating a conventional washing machine.
Figure 2:
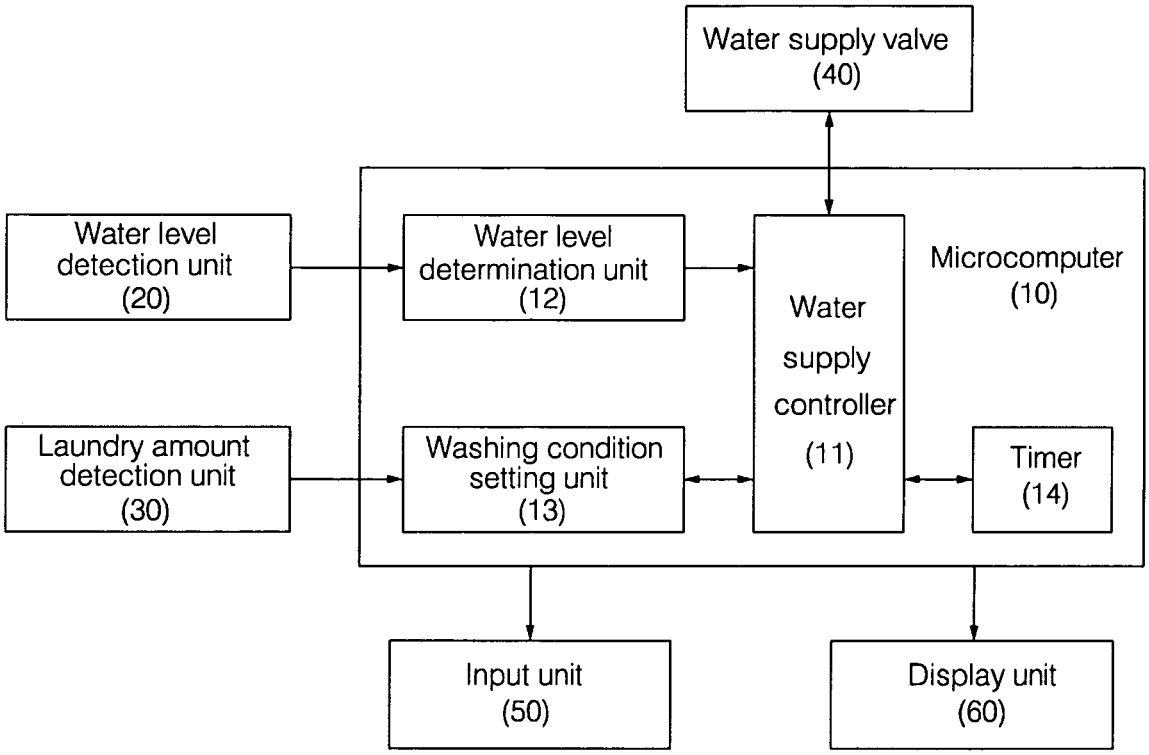
FIG. 2 is a block diagram illustrating the structure of a washing machine in accordance with the present invention.
Figure 3:
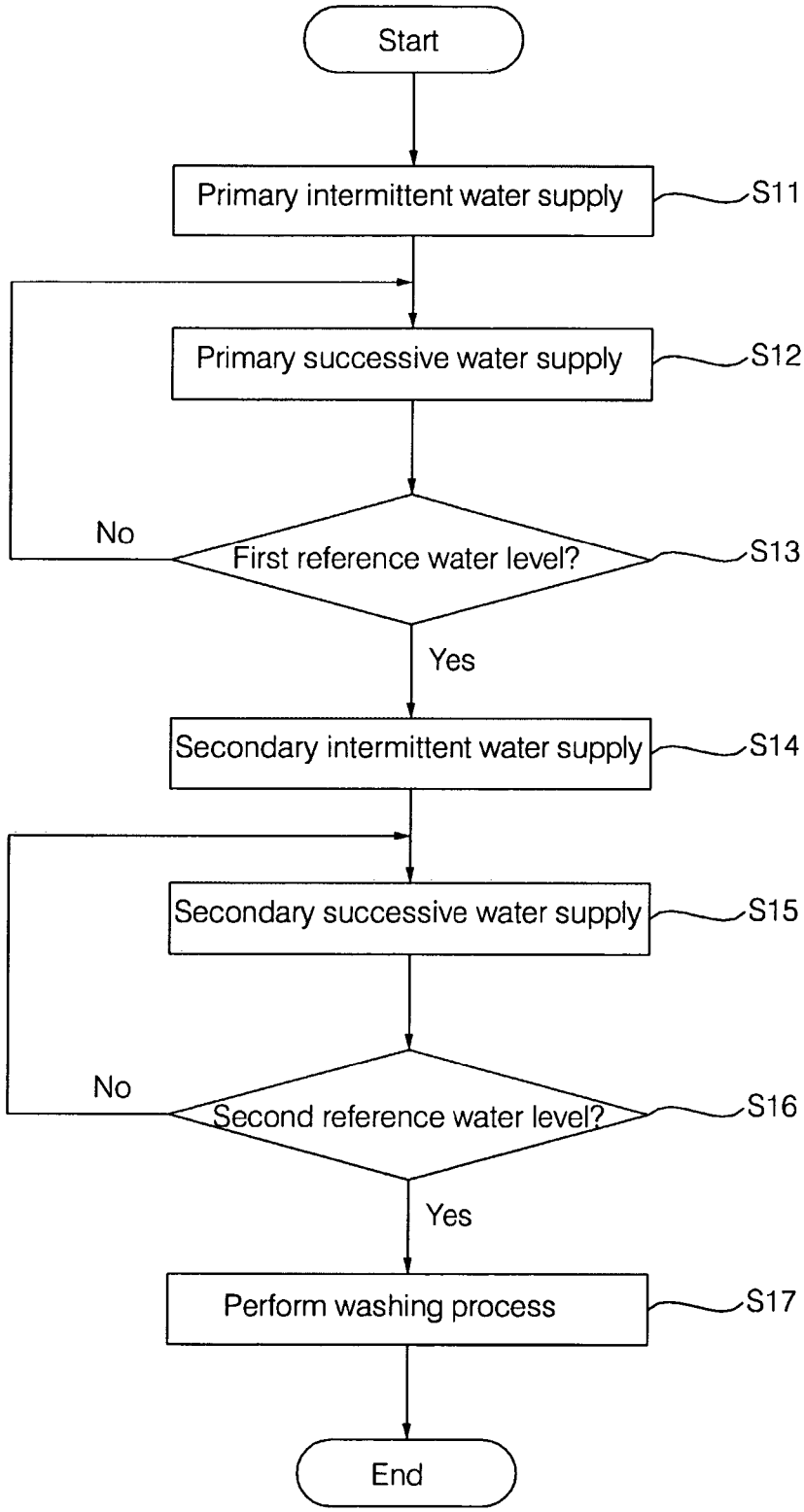
FIG. 3 is a flow diagram illustrating a method for supplying water of the washing machine in accordance with the present invention.
Figure 4:
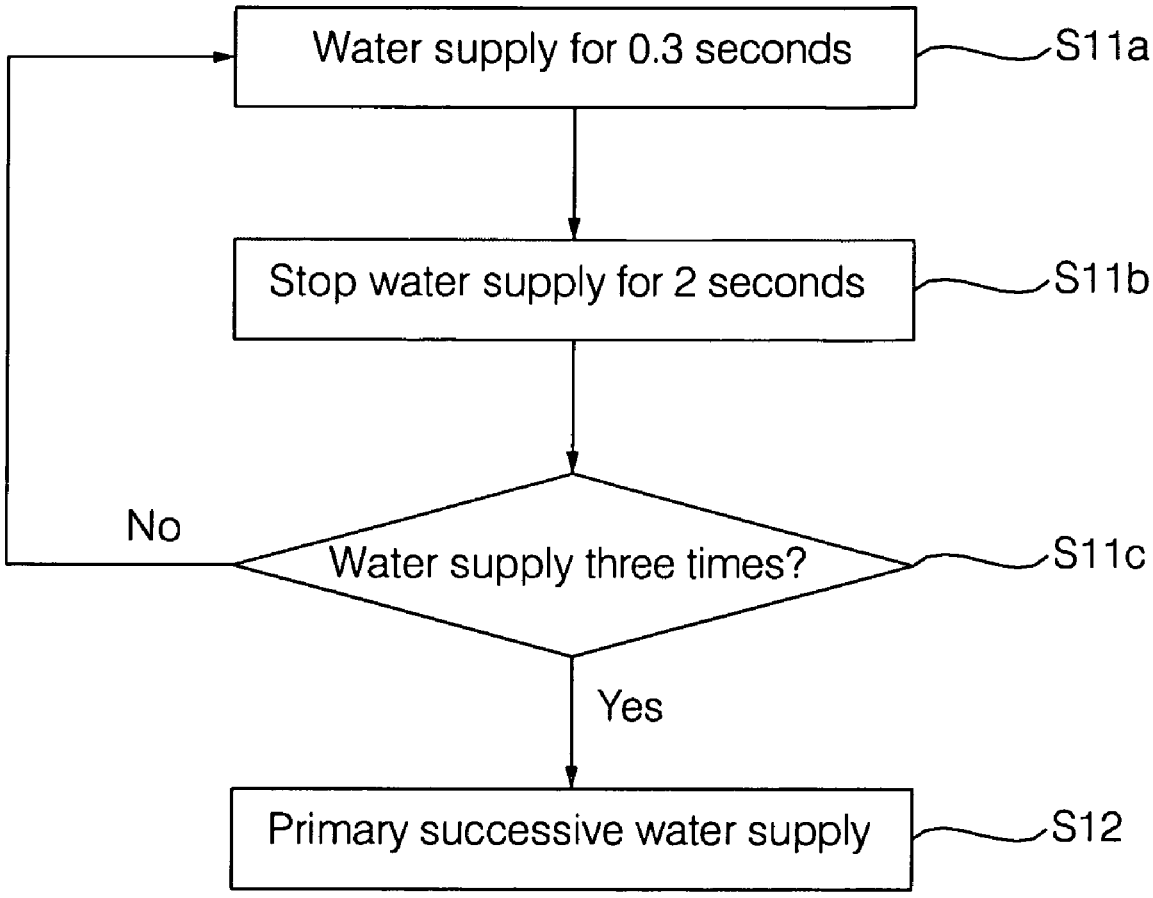
FIG. 4 is a flow diagram illustrating a primary intermittent water supply process in the method of the washing machine in accordance with the present invention.
Figure 5:
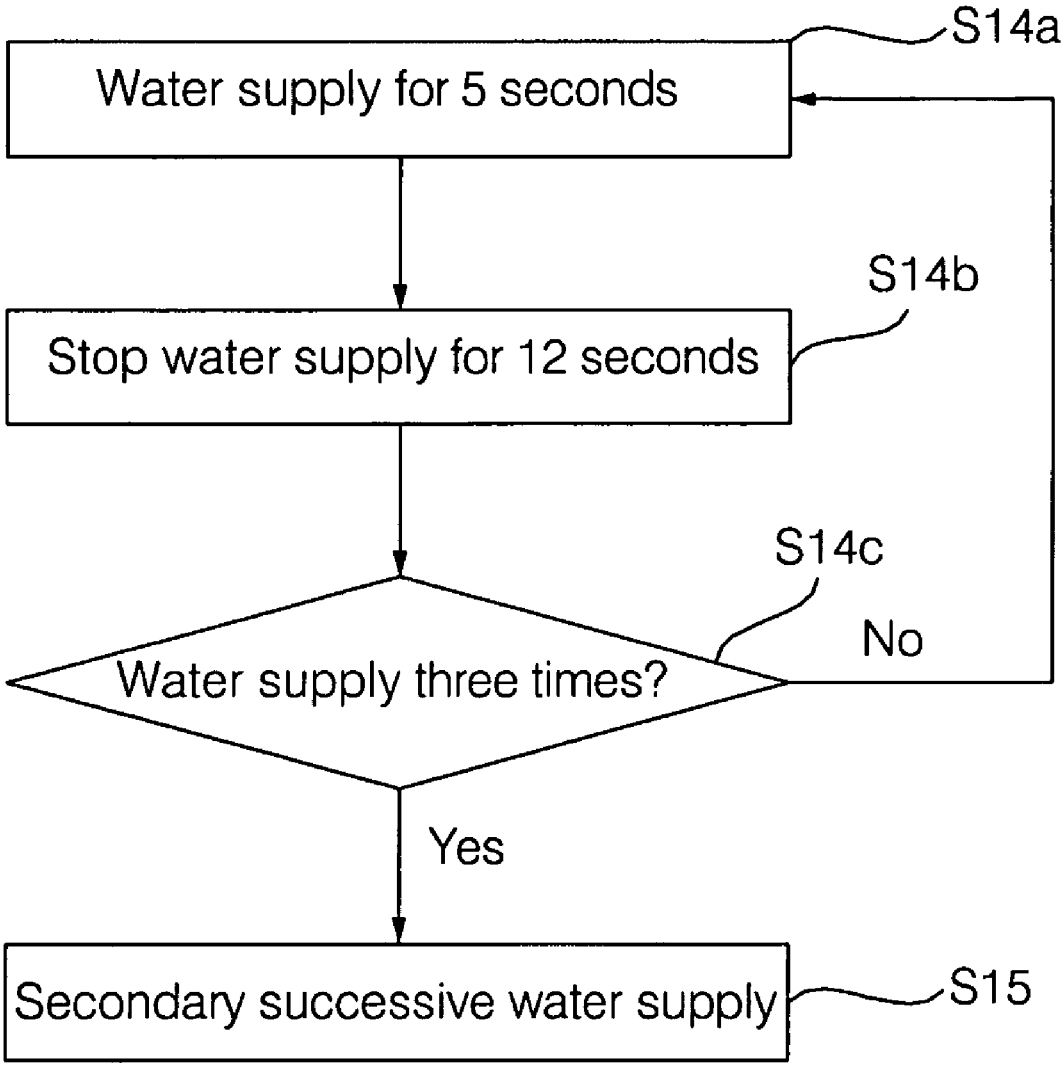
FIG. 5 is a flow diagram illustrating a secondary intermittent water supply process in the method of the washing machine in accordance with the present invention.

FIG. 2 is a block diagram illustrating the structure of a washing machine in accordance with the invention, FIG. 3 is a flow diagram illustrating a method for supplying water of the washing machine in accordance with the invention, FIG. 4 is a flow diagram illustrating a primary intermittent water supply process in the method of the washing machine in accordance with the invention, and FIG. 5 is a flow diagram illustrating a secondary intermittent water supply process in the method of the washing machine in accordance with the invention.

Here, the washing machine of the invention includes a drum type washing machine, a fully automatic washing machine, and the like, which are commonly designed to supply water together with detergent by supplying the water through a detergent barrel.

As shown in FIG. 2, the washing machine of the invention comprises a water supply valve 40 for supplying cold/warm water when performing a washing process, a laundry amount detection unit 30 for detecting an amount of laundry in a tub to set an amount of water for the washing process, and a water level detection unit 20 for detecting a water level so as to control an amount of water supplied from the water supply valve 40 to the tub according to a predetermined amount of supply water.

The washing machine further comprises a motor (not shown) for rotating the tub, an input unit 50 for setting conditions for the washing process of the washing machine, and a display unit 60 for displaying an operational state of the washing machine so as to be confirmed by a user.

Particularly, the washing machine further comprises a microcomputer 10, which can calculate the amount of water for the washing process preset through the input unit according to the amount of laundry detected by the laundry amount detection unit 30, and control the general conditions of the washing process to perform an washing operation by adjusting the amount of water to be supplied from the water supply valve 40 to the tub according to the water level detected by the water level detection unit 20.

The water level detection unit 20 comprises a level detection sensor (not shown) which detects the water level in the tub, and sends the detected water level to the microcomputer 10.

At this time, after detecting the water level in the tub, the level detection sensor sends the detected water level in the form of a frequency to the microcomputer 10, thereby allowing the water supplied from the water supply valve 40 to be adjusted.

The laundry amount detection unit 30 detects the amount of laundry in the tub, and sends it to the microcomputer 10, thereby allowing the water level or a washing time to be set according to the amount of laundry.

The microcomputer 10 sets washing conditions including the amount of water, the washing time and the like for the washing process on the basis of data detected by the water level detection unit 20 or the laundry amount detection unit 30. Additionally, the microcomputer 10 controls the water supply, and allows a series of washing steps to be performed by stopping the water supply when the water level in the tub reaches the predetermined water level.

The microcomputer 10 comprises a water supply controller 11 for controlling the amount of water according to the water level in the tub sent from the water level detection unit 20 while controlling the water supply valve in order to control the water supply time or interval; and a timer 14 for checking a time for which the water is supplied through the water supply valve 20, thereby enabling the water supply interval to be controlled by means of the water supply controller 11.

The microcomputer 10 further comprises a water level determination unit 12 for determining whether the water level detected by the water level detection unit 20 is a predetermined water level, and a washing condition setting unit 13 for calculating the amount of water for the washing process according to the amount of laundry detected by the laundry amount detection unit 30, and setting a final water level according to the result of the calculation.

The washing condition setting unit 13 sets the water level for the washing process according to the detected amount of laundry, and calculates a time for the washing process, such as a washing time, a rinsing time, a dewatering time, and the like.

When a washing course, kinds of water to be supplied between cold water and warm water, and the like, are input to the washing condition setting unit 13 through the input unit 50, the washing condition setting unit 13 sets the washing time, the water level during the washing process, and the like according to the washing course and the amount of laundry detected by the laundry amount detection unit 30, and sends these set washing conditions to the display unit 60, allowing the conditions to be display on the display unit 60.

At this time, the washing condition setting unit 13 sets the water level for the washing process, which will become a reference water level for a continuous water supply when supplying the water intermittently or continuously in multiple steps.

That is, the washing condition setting unit 13 sets the respective reference water levels of multistage continuous water supply. In particular, when the water is continuously supplied twice into the tub, it sets first and second reference water levels according to primary and secondary continuous water supply, respectively. At this time, the second reference water level is the final water level for the washing process.

The first and second reference water levels indicating that the water is supplied to a predetermined water level can be varied according to the amount of laundry detected by the laundry amount detection unit 30.

The water level determination unit 12 determines on the basis of the water level detected by the water level detection unit 20 whether the water level reaches the first or second reference water level.

That is, the water level determination unit 12 determines whether the water level reaches the first or second reference water level by comparing the water level sent from the water level detection unit 20 with the first or second reference water level.

The water supply controller 11 controls the amount of water supplied from the water supply valve 40 to the detergent barrel, thereby allowing the detergent to be smoothly supplied from the detergent barrel into the tub. At this time, the water supply controller 11 controls the water supply to be performed or stopped according to results determined by the water level determination unit 12.

The water supply controller 11 repeats an intermittent water supply and the continuous water supply by adjusting a time for which the water is supplied for detergent supply, and repeats the intermittent water supply a predetermined numbers of times in such a manner of stopping the water supply after the water supply for a short period in order to supply the detergent from the detergent barrel or removing the detergent remaining in the detergent barrel at an initial water supply stage.

At this time, in order to perform the multistage intermittent water supply, the water supply controller 11 specifies the intermittent water supply at the initial water supply stage and at a predetermined water level or more into the primary intermittent water supply and the secondary intermittent water supply, respectively, and sets times for water supply, and times for stopping the water supply depending on whether the primary or secondary intermittent water supply is performed.

That is, when supplying water into the tub at the initial stage, the water supply controller 11 performs the primary intermittent water supply in such a manner that the water is supplied for 0.3 seconds through the water supply valve, and is stopped for 2 seconds. Here, the water supply controller 11 allows the water supply to be performed or stopped according to the time checked by the timer 14.

At this time, the water supply controller 11 repeats the primary intermittent water supply as described above three times.

Additionally, the water supply controller 11 performs a primary continuous water supply for a predetermined time after the primary intermittent water supply, and controls the water supply valve 40 to stop the water supply when it is determined on the basis of water level sent from the water level detection level 20 by the water level determination unit 12 that the water level is the first reference water level in the tub.

The water supply controller 11 performs the primary continuous water supply until the water level reaches the first reference water level set by the washing condition setting unit 13. When the water level reaches the first reference water level in the tub, the water supply controller 11 stops the continuous water supply, and performs a secondary intermittent water supply.

The secondary intermittent water supply is repeated five times by the water supply controller 11 in such a manner that the water is supplied for 5 seconds, and is stopped for 12 seconds.

After the secondary intermittent water supply, the water supply controller 11 performs the continuous water supply until the water level reaches a second reference water level in order to perform the washing process.

Accordingly, the washing machine repeats the intermittent water supply and the continuous water supply, and differently sets the time for the intermittent water supply, so that the detergent can be smoothly supplied into the tub through the repeated intermittent water supply even if the detergent is coagulated in the detergent barrel or is formed thereon with a film causing the detergent to remain in the detergent barrel, thereby removing the remaining detergent.

A method for supplying water of the washing machine constructed as described above will be described with reference to FIGS. 3 to 5.

When conditions for a washing process including a washing course are set in order to remove contaminants stuck to laundry, an amount of laundry is detected, and an amount of water supply, a washing time and the like for the washing process are set according to the detected amount of laundry.

At a water supply step, water is supplied from the water supply valve to the tub via the detergent barrel so that detergent in the detergent barrel is supplied into the tub.

At this time, in order to ensure smooth supply of detergent, a primary intermittent water supply is performed (S11).

The primary intermittent water supply is performed in such a manner that the water is supplied for 0.3 seconds into the tub (S11*a*), and is stopped for 2 seconds (S11*b*).

The number of times of water supply is detected (S11*c*), and then supply/stop of water is repetitiously performed a predetermined number of times (S11*a* to S11*c*).

At this time, when the water supply is not performed the predetermined number of times, the primary intermittent water supply as described above is repeated (S11*b*) after the water supply is stopped for 2 seconds.

Here, the primary intermittent water supply is repeated 2 to 5 times, and is preferably repeated three times, in particular, for supplying the detergent.

After repeating the primary intermittent water supply, a continuous water supply is performed until a water level reaches a predetermined water level in the tub (S12).

A primary continuous water supply is performed until the water level reaches a first reference water level in the tub, and during the water supply, the level of water periodically supplied is continuously detected.

At this time, it is determined based on a detected water level whether an amount of water supplied to the tub reaches the first reference water level. When the amount of water does not reach the first reference water level, the water supply is continued, and when the amount of water reaches the first reference water level, the water supply is stopped (S13).

When the detected water level is the first reference water level or more, it is determined that the amount of water supplied to the tub reaches the first reference water level, and the continuous water supply is stopped. At this time, the first reference water level is set based on a final water level set according to the detected amount of laundry, and thus can be varied according to the amount of laundry.

When the primary continuous water supply is stopped, a secondary intermittent water supply is performed (S14).

The secondary intermittent water supply is performed in such a manner that the water is supplied for 5 seconds into the tub (S14*a*), and is stopped for 12 seconds (S14*b*).

Here, after stopping the water supply, the number of times of water supply is detected and then supply/stop of water is repetitiously performed the predetermined number of times as described above (S14*c*).

The secondary intermittent water supply is repeated 2 to 5 times, and is preferably repeated three times, in particular, for supplying the detergent.

That is, when it is determined after checking the number of times of water supply that the secondary intermittent water supply has been repeated less than three times, the secondary intermittent water supply, in which the water is supplied for 5 seconds after the water supply is stopped for 12 seconds, is repeated.

After finishing the secondary intermittent water supply, a secondary continuous water supply is performed until the water level reaches a second reference water level in the tub (S15).

The water level is continuously detected in order to determine whether the water level reaches the second reference water level, and the water supply is continued such that the water level reaches the second reference water level for the washing process through the second continuous water level (S16).

After finishing the water supply, the washing process including the steps of washing, rinsing, dewatering and the like is performed in order to remove the contaminants stuck to the laundry (S17).

The washing machine and the method for supplying water thereof perform a multistage water supply process which repeats an intermittent water supply and a continuous water supply in such a manner of supplying water and stopping the water supply, and differently sets water supply time for the primary intermittent water supply and the secondary intermittent water supply, thereby allowing a detergent to be smoothly supplied to the tub while preventing the detergent from remaining in the detergent barrel.

Thus, the washing machine and the method for supplying water thereof enable smooth supply of detergent, thereby preventing consumption of detergent while enhancing user convenience by allowing the detergent remaining in the detergent barrel to be completely removed during the washing process by the water supplied to the tub.

Additionally, the washing machine and the method for supplying water thereof remove the detergent remaining in the detergent barrel as described above, and thus reduce contamination of the laundry caused by the detergent, thereby enhancing sanitation of the laundry.

It should be understood that the embodiments and the accompanying drawings as described above have been described for illustrative purposes and the present invention is limited by the following claims. Further, those skilled in the art will appreciate that various modifications, additions and substitutions are allowed without departing from the scope and spirit of the invention as set forth in the accompanying claims.

What is claimed is:

1. A washing method of a washing machine, comprising:

the first step of performing a primary intermittent water supply at an initial water supply stage for allowing detergent in a detergent barrel to be supplied into a tub;

the second step of performing a primary continuous water supply for supplying water to a first reference water level in the tub;

the third step of performing a secondary intermittent water supply for removing the detergent remaining in the detergent barrel; and the fourth step of performing a secondary continuous water supply for continuously supplying water to a second reference water level in the tub.

2. The method as set forth in claim 1, wherein at the first step, the primary intermittent water supply is repeated in such a manner of supplying the water for a short period and then stopping the water supply for a predetermined period such that the detergent is supplied to the tub together with the water supplied to the tub.

3. The method as set forth in claim 2, wherein the primary intermittent water supply is performed in such a manner of supplying the water for 0.3 seconds, and then stopping the water supply for 2 seconds.

4. The method as set forth in claim 3, wherein at the first step, the primary intermittent water supply is repeated three times.

5. The method as set forth in claim 1, wherein at the third step, the secondary intermittent water supply is repeated in such a manner of supplying the water for 5 seconds and then stopping the water supply for 12 seconds to remove the detergent remaining in the detergent barrel.

6. The method as set forth in claim 5, wherein at the third step, the secondary intermittent water supply is repeated three times.

7. The method as set forth in claim 1, further comprising: the fourth step of detecting an amount of laundry in the tub.

8. The method as set forth in claim 7, wherein the first and second reference water levels are varied according to the detected amount of laundry.

* * * * *